US008177583B2

(12) United States Patent
Chawgo et al.

(10) Patent No.: US 8,177,583 B2
(45) Date of Patent: May 15, 2012

(54) COMPRESSION CONNECTOR FOR COAXIAL CABLE

(75) Inventors: Shawn Chawgo, Cicero, NY (US); Noah Montena, Syracuse, NY (US); Eric Purdy, Constantia, NY (US); Daniel Robb, East Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 13/174,697

(22) Filed: Jun. 30, 2011

(65) Prior Publication Data

US 2011/0263154 A1 Oct. 27, 2011

Related U.S. Application Data

(63) Continuation-in-part of application No. 11/743,633, filed on May 2, 2007, now Pat. No. 7,993,159, and a continuation of application No. 12/469,313, filed on May 20, 2009, now Pat. No. 8,007,314.

(51) Int. Cl.
*H01R 9/05* (2006.01)

(52) U.S. Cl. ..... 439/584

(58) Field of Classification Search ..... 439/583, 439/584, 578

See application file for complete search history.

(56) References Cited

U.S. PATENT DOCUMENTS 3,764,959 A 10/1973 Toma et al.
3,910,673 A 10/1975 Stokes
4,531,805 A 7/1985 Werth
4,579,415 A 4/1986 Van Brunt et al.
4,676,577 A 6/1987 Szegda
4,808,128 A 2/1989 Werth
4,952,174 A 8/1990 Sucht et al.
5,199,894 A 4/1993 Kalny et al.
5,322,454 A 6/1994 Thommen
5,393,244 A 2/1995 Szegda
5,435,745 A 7/1995 Booth
5,620,339 A 4/1997 Gray et al.
5,720,630 A 2/1998 Richmond et al.
5,766,037 A 6/1998 Nelson
5,863,220 A 1/1999 Holliday
5,938,474 A 8/1999 Nelson
6,019,519 A 2/2000 Grinderslev et al.
6,019,636 A 2/2000 Langham
6,032,358 A 3/2000 Wild
6,102,738 A 8/2000 Macek et al.
6,109,964 A 8/2000 Kooiman (Continued)

OTHER PUBLICATIONS

U.S. Appl. No. 12/421,894, filed Apr. 10, 2009.

(Continued)

*Primary Examiner* — Briggitte R Hammond
(74) *Attorney, Agent, or Firm* — Schmeiser Olsen & Watts

(57) ABSTRACT

A compression connector for smooth walled, corrugated, and spiral corrugated coaxial cable includes an insulator disposed within the body, wherein the insulator contains a central opening therein which is dimensioned smaller than a collet portion which seizes a center conductor of the coaxial cable. The connector also includes a clamp disposed inside the body as well as a compression sleeve assembly. An intermediate connector element includes a transitional surface which interacts with the clamp. When an axial force is applied to the compression sleeve, the clamp is forced by the transitional surface into the body, causing the clamp to squeeze onto an outer conductor layer of the coaxial cable. At approximately the same time, the collet portion is forced through the central opening of the insulator, causing the collet portion to squeeze onto the center conductor.

9 Claims, 18 Drawing Sheets

U.S. PATENT DOCUMENTS

| | | | |
|---|---|---|---|
| 6,133,532 | A | 10/2000 | Lundback et al. |
| 6,183,298 | B1 | 2/2001 | Henningsen et al. |
| 6,206,579 | B1 | 3/2001 | Selfridge et al. |
| 6,264,374 | B1 | 7/2001 | Selfridge et al. |
| 6,267,621 | B1 | 7/2001 | Pitschi et al. |
| 6,309,251 | B1 | 10/2001 | Tang |
| 6,331,123 | B1 | 12/2001 | Rodrigues |
| 6,386,915 | B1 | 5/2002 | Nelson |
| 6,471,545 | B1 | 10/2002 | Hosler, Sr. |
| 6,478,618 | B2 | 11/2002 | Wong |
| 6,494,743 | B1 | 12/2002 | Lamatsch et al. |
| 6,607,398 | B2 | 8/2003 | Henningsen |
| 6,733,336 | B1 | 5/2004 | Montena et al. |
| 6,840,803 | B2 | 1/2005 | Wlos et al. |
| 6,884,113 | B1 | 4/2005 | Montena |
| 6,939,169 | B2 | 9/2005 | Islam et al. |
| 6,955,562 | B1 | 10/2005 | Henningsen |
| 7,008,264 | B2 | 3/2006 | Wild |
| 7,021,965 | B1 | 4/2006 | Montena |
| 7,029,304 | B2 | 4/2006 | Montena |
| 7,029,326 | B2 | 4/2006 | Montena |
| 7,070,447 | B1 | 7/2006 | Montena |
| 7,077,699 | B2 | 7/2006 | Islam et al. |
| 7,086,897 | B2 | 8/2006 | Montena |
| 7,104,839 | B2 | 9/2006 | Henningsen et al. |
| 7,108,547 | B2 | 9/2006 | Kisling et al. |
| 7,112,093 | B1 | 9/2006 | Holland |
| 7,128,603 | B2 | 10/2006 | Burris et al. |
| 7,131,868 | B2 | 11/2006 | Montena |
| 7,156,560 | B2 | 1/2007 | Seeley |
| 7,156,696 | B1 | 1/2007 | Montena |
| 7,163,420 | B2 | 1/2007 | Montena |
| 7,189,115 | B1 | 3/2007 | Montena |
| 7,207,838 | B2 | 4/2007 | Andreescu |
| 7,264,502 | B2 | 9/2007 | Holland |
| 7,278,854 | B1 | 10/2007 | Robinette et al. |
| 7,303,435 | B2 | 12/2007 | Burris et al. |
| 7,309,255 | B2 | 12/2007 | Rodrigues |
| 7,347,729 | B2 | 3/2008 | Thomas et al. |
| 7,351,101 | B1 | 4/2008 | Montena |
| 7,357,672 | B2 | 4/2008 | Montena |
| 7,458,851 | B2 | 12/2008 | Montena |
| 7,497,729 | B1 | 3/2009 | Wei |
| 7,566,243 | B1 | 7/2009 | Hung |
| 7,588,460 | B2 | 9/2009 | Malloy et al. |
| 7,993,159 | B2 | 8/2011 | Chawgo |
| 8,007,314 | B2 | 8/2011 | Chawgo et al. |
| 2005/0079761 | A1 | 4/2005 | Rodrigues |
| 2006/0014427 | A1 | 1/2006 | Islam et al. |
| 2006/0134979 | A1 | 6/2006 | Henningsen |
| 2006/0199431 | A1 | 9/2006 | Paynter |
| 2006/0246774 | A1 | 11/2006 | Buck |
| 2007/0149047 | A1 | 6/2007 | Wild et al. |
| 2007/0270032 | A1 | 11/2007 | Eriksen |
| 2008/0003873 | A1 | 1/2008 | Henningsen |
| 2008/0274643 | A1 | 11/2008 | Chawgo |
| 2009/0197465 | A1 | 8/2009 | Montena et al. |
| 2009/0233482 | A1 | 9/2009 | Chawgo et al. |
| 2010/0261381 | A1 | 10/2010 | Montena et al. |
| 2010/0261382 | A1 | 10/2010 | Montena et al. |

OTHER PUBLICATIONS

U.S. Appl. No. 12/421,855, filed Apr. 20, 2009.

U.S. Appl. No. 12/421,826, filed Apr. 10, 2009.

PCT/US2008/061487. International Search Report and Written Opinion. Date of Mailing: Sep. 26, 2008. 11 pp.

PCT/US2010/034972. International Search Report and Written Opinion. Date of Mailing: Nov. 26, 2010. 10 pp.

EP08746837. Extended European Search Report. Date of Completion of Search: Dec. 17, 2010. 7 pp.

COMPRESSION CONNECTOR FOR COAXIAL CABLE

CROSS REFERENCE TO RELATED APPLICATION[S]

This application is a continuation of the earlier U.S. patent application Ser. No. 12/469,313 filed on May 20, 2009 and entitled COMPRESSION CONNECTOR FOR COAXIAL CABLE, now pending, which is a continuation-in-part of and claims priority from U.S. patent application Ser. No. 11/743,633 filed on May 2, 2007 and entitled COMPRESSION CONNECTOR FOR COAXIAL CABLE, now pending, the disclosures of which are hereby incorporated entirely herein by reference.

BACKGROUND

1. Technical Field

This invention relates generally to the field of coaxial cable connectors, and more particularly to a compression connector for smooth walled, corrugated, and spiral corrugated coaxial cable.

2. State of the Art

Coaxial cable is installed on a widespread basis in order to carry signals for communications networks such as cable television (CATV) and computer networks. The coaxial cable must at some point be connected to network equipment ports. In general, it has proven difficult to make such connections without requiring labor intensive effort by highly skilled technicians.

These generalized installation problems are also encountered with respect to spiral corrugated coaxial cable, sometimes known as "Superflex" cable. Examples of spiral corrugated cable include 50 ohm "Superflex" cable and 75 ohm "coral" cable manufactured by Andrew Corporation (www.andrew.com). Spiral corrugated coaxial cable is a special type of coaxial cable that is used in situations where a solid conductor is necessary for shielding purposes, but it is also necessary for the cable to be highly flexible. Unlike standard coaxial cable, spiral corrugated coaxial cable has an irregular outer surface, which makes it difficult to design connectors or connection techniques in a manner that provides a high degree of mechanical stability, electrical shielding, and environmental sealing, but which does not physically damage the irregular outer surface of the cable. Ordinary corrugated, i.e., non-spiral, coaxial cable also has the advantages of superior mechanical strength, with the ability to be bent around corners without breaking or cracking. In corrugated coaxial cables, the corrugated sheath is also the outer conductor.

When affixing a cable connector to a coaxial cable, it is necessary to provide good electrical and physical contact between the cable connector and the center and outer conductors of the cable. It is also desirable to connect the center and outer conductors without having to reposition the cable connector within a connecting tool during the connection operation. Compression connectors for coaxial cable are known which require dual stage compression to independently activate both inner conductor and outer conductor mechanisms, thus requiring a complex compression tool to accomplish the compression when installing the compression connector onto the coaxial cable.

SUMMARY

Often, to minimize the number of contacts in series in a given electrical path, such as the ground path, within a cable connector, it is desirable to have the moveable clamping element which contacts the outer conductor of a coaxial cable make direct contact with the stationary outer housing of the connector. Such a design is shown in FIGS. 1-12 of this and the parent application. However, due to particular considerations necessitating maximizing the actual area of contact between components which undergoes wiping as the parts move relative to one another, or to adapt body cavities within the cable connector, which must be large for impedance matching, to clamps which must be small to accommodate fitting of coaxial cable while maintaining flexibility or resilience, an intermediate connector element (or transition member) is inserted between the connector housing and the clamp.

Briefly stated, a compression connector for smooth walled, corrugated, and spiral corrugated coaxial cable includes an insulator disposed within the body, wherein the insulator contains a central opening therein which is dimensioned smaller than a collet portion which seizes a center conductor of the coaxial cable. The connector also includes a clamp disposed inside the body as well as a compression sleeve assembly. An intermediate connector element includes a transitional surface which interacts with the clamp. When an axial force is applied to the compression sleeve, the clamp is forced by the transitional surface into the body, causing the clamp to squeeze onto an outer conductor layer of the coaxial cable. At approximately the same time, the collet portion is forced through the central opening of the insulator, causing the collet portion to squeeze onto the center conductor. The collet portion can be designed to be simultaneously squeezed onto the center conductor at the same time the clamp compresses the outer conductor layer, or the engagement of the collet portion with the center conductor can be designed to be delayed.

According to an embodiment of the invention, a compression connector for a coaxial cable, wherein the coaxial cable includes a center conductor surrounded by a dielectric, which dielectric is surrounded by a conductor layer, includes a connector body having a first end and a second end and a central passageway therethrough; an insulator disposed within the central passageway at the first end of the body; the insulator having an opening therein; a compression sleeve assembly connected to the second end of the body; first clamp means, disposed in the central passageway, for clamping onto the conductor layer; and second clamp means, disposed within the central passageway, for clamping onto the center conductor, whereby upon axial advancement of the compression sleeve assembly from the second end to the first end, the first and second clamp means are radially compressed inwardly.

According to an embodiment of the invention, a method for installing a compression connector onto a coaxial cable, wherein the coaxial cable includes a center conductor surrounded by a dielectric, which dielectric is surrounded by a conductor layer, includes the steps of (a) forming a connector body having a first end and a second end, and a central passageway therethrough; (b) forming an insulator for placement within the central passageway at the first end of the body, wherein the insulator includes an opening therein; (c) forming a conductive pin having a collet portion at one end thereof, wherein an outer diameter of the collet portion is greater than a diameter of the opening in the insulator, such that forcing the conductive pin in the longitudinally axial direction causes the outer diameter of the collet portion to reduce in size as the collet portion is forced into the opening; (d) forming a compression sleeve assembly for connection to the second end of the body; (e) forming a clamp and disposing the clamp on an inside of the body, the clamp having a first portion and a second portion, wherein the first portion has an outer engagement surface and the second portion has an outer diameter; (f) forming a mandrel for placement between the clamp and the collet portion; (g) forming a transition member and disposing the transition member between the mandrel and the clamp, wherein the transition member includes a transition surface on an inside of the transition member and a smooth surface on an outside of the transition member such that the transition member and the body make good electrical contact; (h) wherein a diameter of the smooth surface of the transition member and the outer diameter of the second portion of the clamp are the same; (i) wherein forcing the clamp in the longitudinally axial direction causes the outer engagement surface to interact with the transition surface such that the first portion of the clamp reduces inwardly in size; and (j) wherein an axial movement of the compression assembly causes both the clamp and the collet portion to clamp inwardly.

The foregoing and other features and advantages of the present invention will be apparent from the following more detailed description of the particular embodiments of the invention, as illustrated in the accompanying drawings.

DETAILED DESCRIPTION OF EMBODIMENTS

Figure 1A:
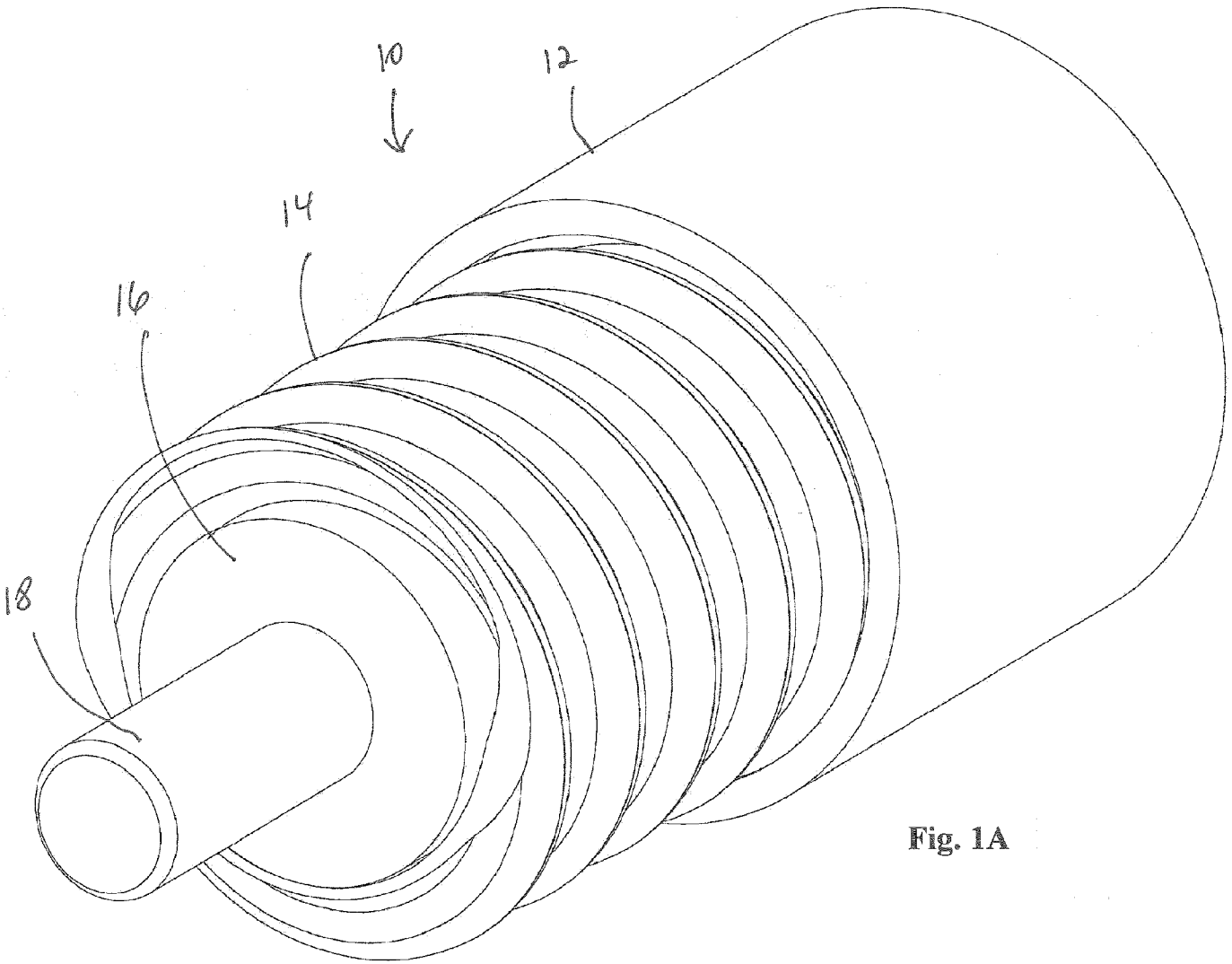
FIG. 1A shows a perspective view of a spiral corrugated coaxial cable where an end has been prepared for engagement with a coaxial cable connector.
Figure 2:
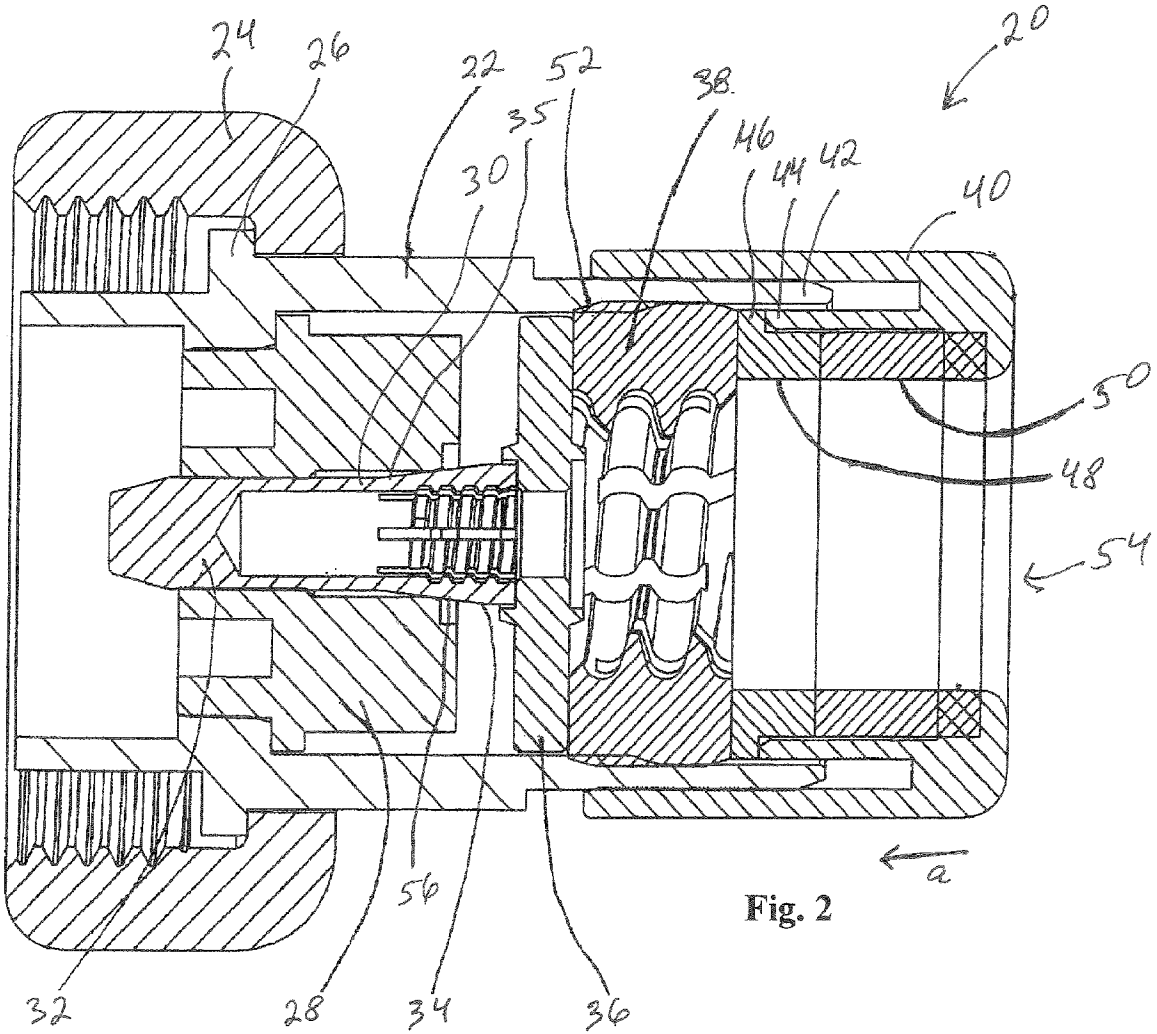
FIG. 2 shows a perspective view with a partial cut-away of a coaxial cable connector in a partially compressed position in accordance with a first embodiment of the present invention.

Referring to FIG. 1A, a spiral corrugated coaxial cable 10 is shown prepared for installation onto a compression connector 20 (FIG. 2). A jacket 12 is cutaway to expose a portion of a spiral corrugated conductor layer 14. Layer 14 is also known as the ground or outer conductor layer. Both corrugated conductor layer 14 and a dielectric 16 are cutaway from a center conductor 18. Preparation of corrugated coaxial cable 10 for installation is well known in the art.

Figure 1B:
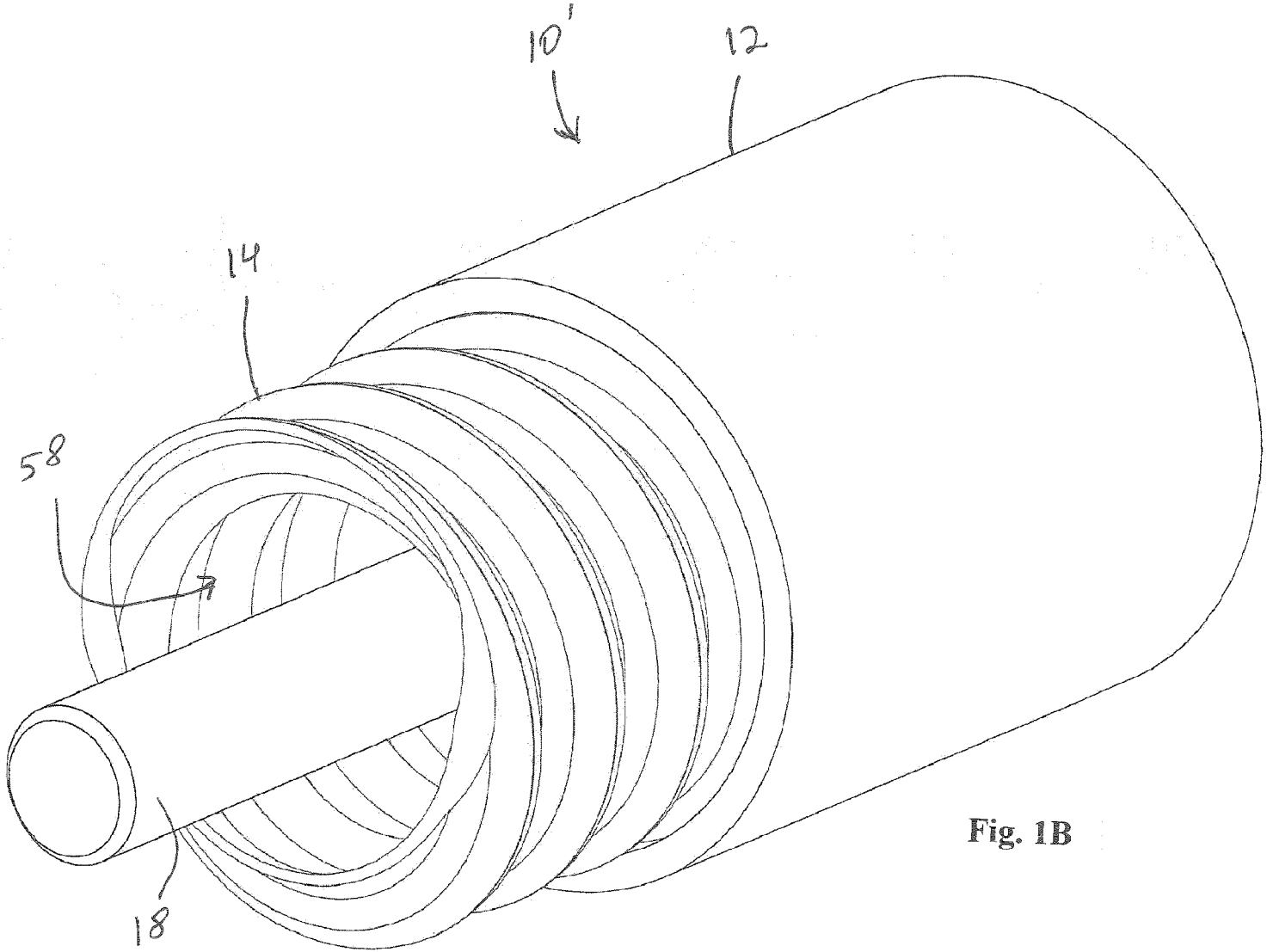
FIG. 1B shows a perspective view of the spiral corrugated coaxial cable of FIG. 1A with the dielectric foam removed.
Figure 6:
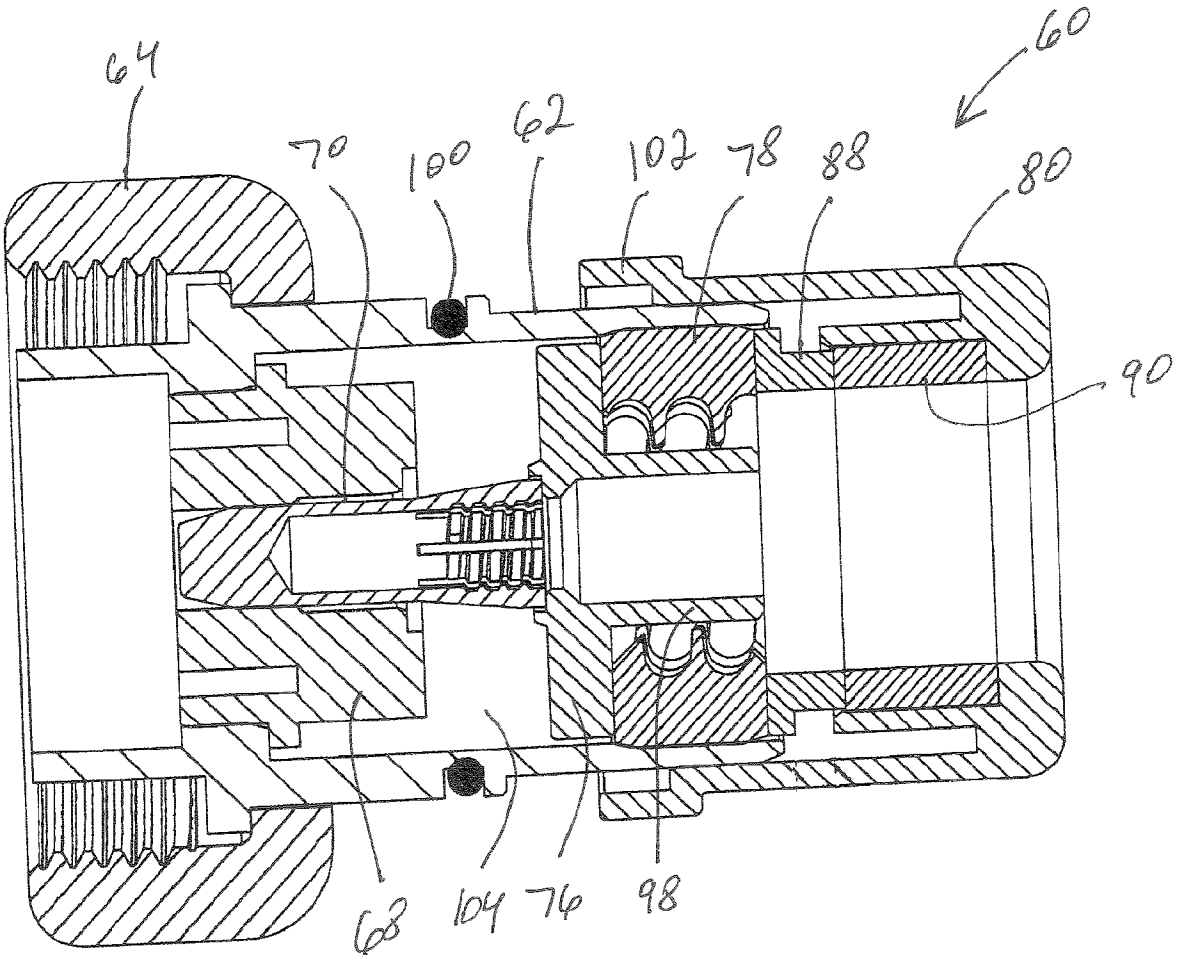
FIG. 6 shows a cross sectional view of a coaxial cable connector in accordance with a variation of the second embodiment of the present invention.

Referring to FIG. 1B, a spiral corrugated coaxial cable 10' is shown prepared for installation onto a compression connector 60 (FIG. 6). In addition to jacket 12 being cutaway to expose a portion of spiral corrugated conductor layer 14, dielectric 16 is cored out leaving a hollow 58 after both corrugated conductor layer 14 and dielectric 16 are cutaway from center conductor 18. Preparation of corrugated coaxial cable 10' for installation is well known in the art.

Figure 1C:
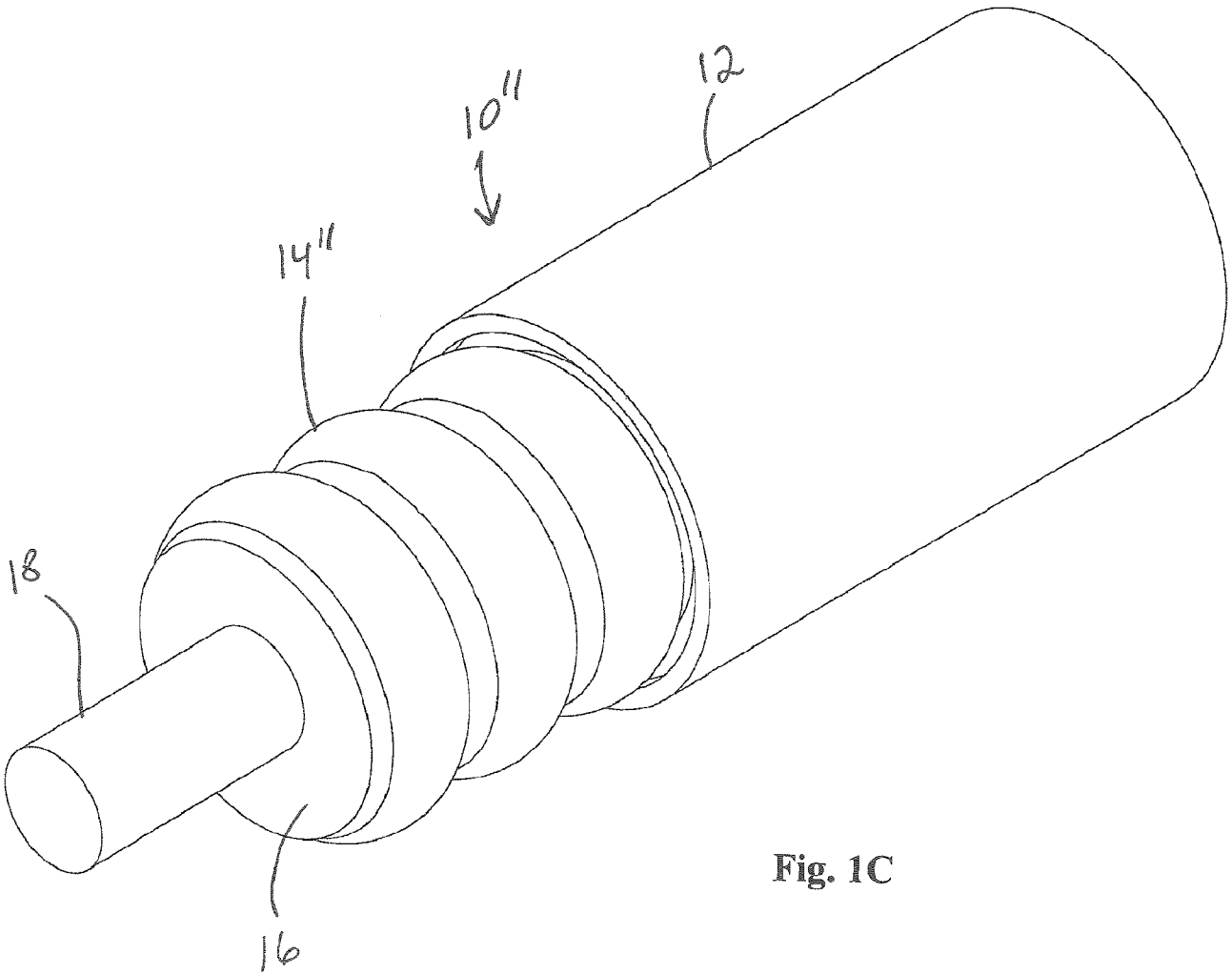
FIG. 1C shows a perspective view of an annular corrugated coaxial cable where an end has been prepared for engagement with a coaxial cable connector.

Referring to FIG. 1C, a non-spiral corrugated coaxial cable 10" is shown prepared for installation onto a compression connector. The preparation of cable 10" is well known in the art, and is the same as previously described with respect to FIG. 1A. Note that corrugated conductor layer 14" is non-spiral, but still corrugated. The basic steps of preparing a corrugated coaxial cable are known in the prior art, such as removing a portion of the cable jacket or coring the dielectric foam. For example, it is known to cut away the corrugated outer conductor in a "valley" to ensure enough of the "peak" is left for outer conductor seizure. However, the present invention allows the outer conductor to be cut in either the "peak" or a "valley" because of the configuration of the inner surface of the outer conductor clamp.

Figure 1D:
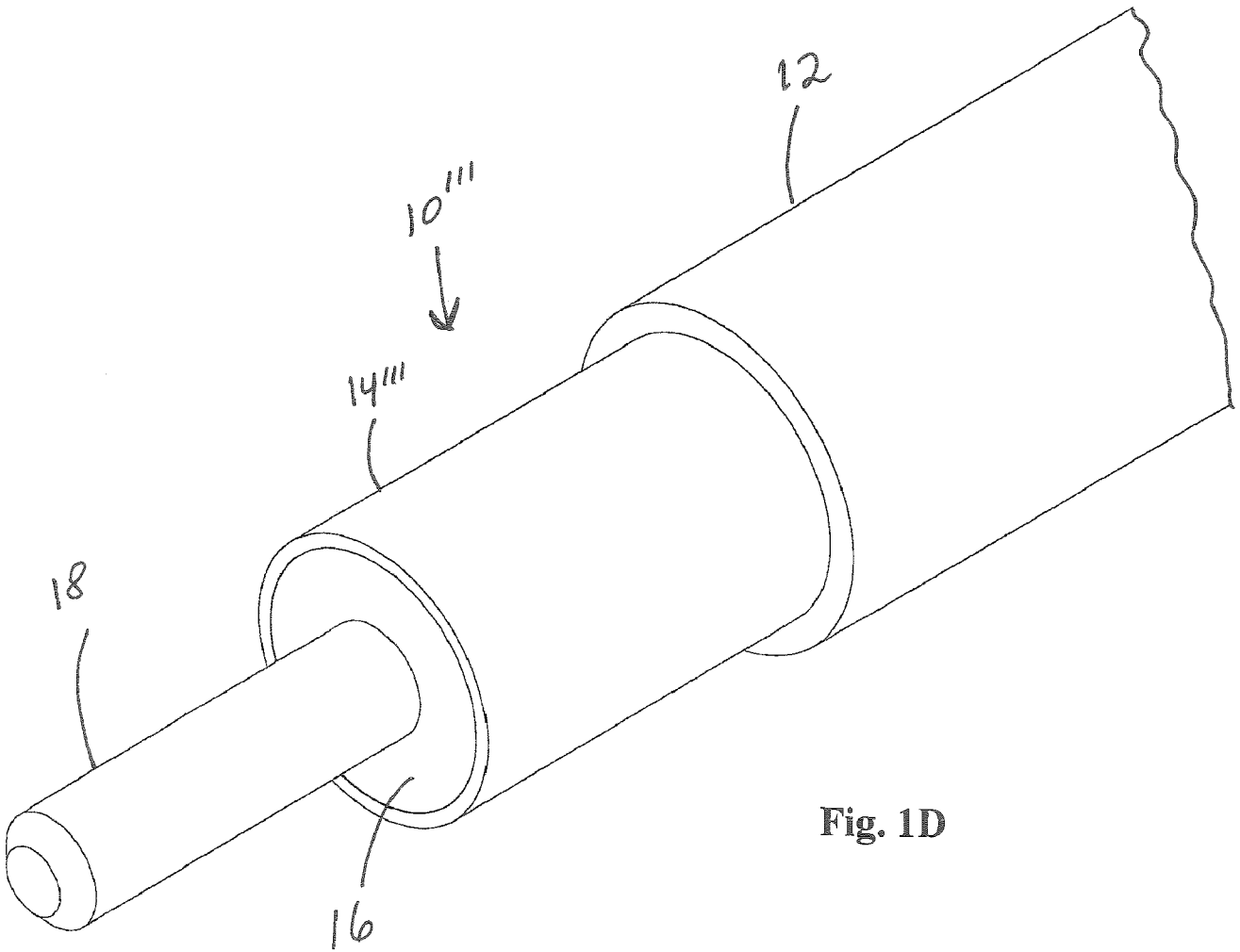
FIG. 1D shows a perspective view of a smooth-walled coaxial cable where an end has been prepared for engagement with a coaxial cable connector.

Referring to FIG. 1D, a smooth walled coaxial cable 10'" is shown prepared for installation onto a compression connector. The preparation of cable 10'" is well known in the art, and is the same as previously described with respect to FIG. 1A. Note that conductor layer 14'" is non-spiral and non-corrugated, i.e., smooth walled.

Figure 1E:
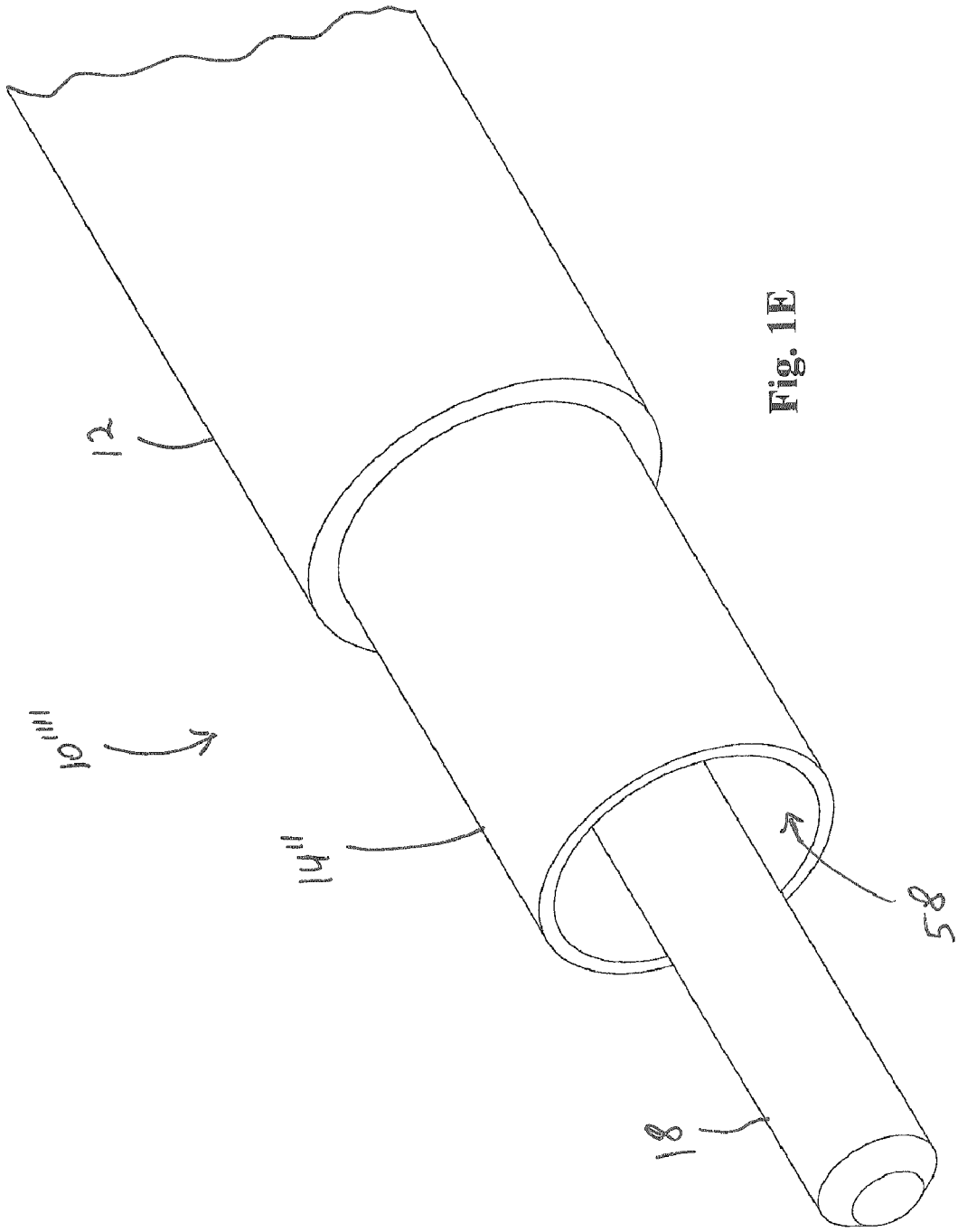
FIG. 1E shows a perspective view of the smooth-walled coaxial cable of FIG. 1D with the dielectric foam removed.

Referring to FIG. 1E, a smooth walled coaxial cable 10"" is shown prepared for installation onto a compression connector. In addition to jacket 12 being cutaway to expose a portion of conductor layer 14", dielectric 16 (FIG. 1D) is cored out leaving a hollow 58 after both conductor layer 14 and dielectric 16 are cutaway from center conductor 18. Preparation of coaxial cable 10'''' for installation is well known in the art.

Referring also to FIG. 2, compression connector 20, shown in a partially compressed position, includes a body 22 with a nut 24 connected to body 22 via an annular flange 26. An insulator 28 positions and holds a conductive pin 30 within body 22. Conductive pin 30 includes a pin portion 32 at one end and a collet portion 34 at the other end. A drive insulator or mandrel 36 is positioned inside body 22 between and end of collet portion 34 and a clamp 38. Clamp 38 has an interior annular surface which is geometrically congruent to the spiral of spiral corrugated conductor layer 14. Clamp 38 preferably includes a plurality of slots 39 (FIG. 4) in an outer annular portion of the clamp, so that clamp 38 can be compressed or squeezed inward. A part of a compression sleeve 40 fits over an end 42 of body 22. A drive portion 44 of compression sleeve 40 fits against an annular flange 46 of a drive ring 48. An elastomer seal 50 fits against jacket 12 of corrugated coaxial cable 10 during installation to prevent external environmental influences (moisture, grit, etc.) from entering connector 20 as well as to provide strain relief and increase cable retention.

When prepared corrugated coaxial cable 10 is inserted into an opening 54 of connector 20, cable 10 is twisted as it is inserted so that the spirals on conductor layer 14 fit into the spirals in clamp 38, while center conductor 18 fits into collet portion 34. When compressive force is applied to compression sleeve 40 in the direction indicated by an arrow a, drive portion 44 of compression sleeve 40 drives drive ring 48 against clamp 38, forcing clamp 38 against a transition surface 52 of body 22, which transition surface 52 is configured to radially inwardly squeeze clamp 38 against conductor layer 14, while continuing to move clamp 38 axially in the direction of arrow a. Clamp 38 thus forces mandrel 36 to move in the direction of arrow a, and mandrel 36 forces collet portion 34 of conductive pin 30 through an opening 56 in insulator 28. Opening 56 may take various forms, including convex, concave, or radial. Collet portion 34 also has a collet transition surface 35 configured to compress collet portion 34 radially inwardly upon advancement of conductive pin 30 into opening 56 of insulator 28. Because a diameter of opening 56 is smaller than an outer diameter ramped surface 35 of collet portion 34, collet portion 34 is squeezed onto and seizes center conductor 18 of corrugated coaxial cable 10. During the clamping process, it is noted that center conductor 18, now located within conductive pin 30, does not move relative to pin 30 during the clamping process. With the transition surface as shown in FIG. 2, the collet portion 34 is simultaneously compressed radially inwardly at the same time clamp 38 is compressed radially inwardly. The transition surface 35 however, can be designed to have a portion of surface 35 consistent with the diameter of opening 56. In this instance, the squeezing of collet portion 34 is delayed until a greater advancement of compression sleeve 40.

Figure 3:
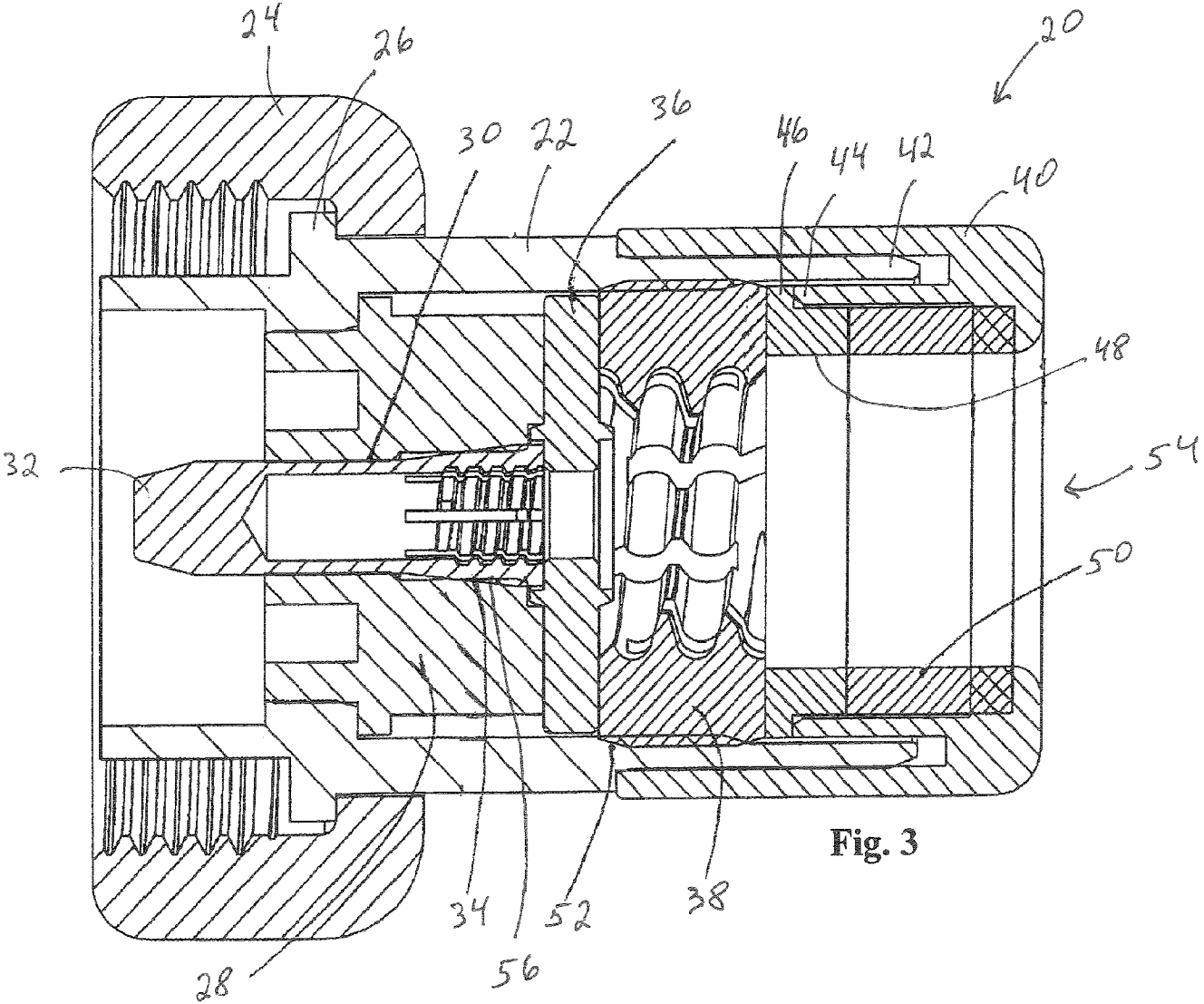
FIG. 3 shows a cross-section of the coaxial cable connector of FIG. 2 shown in the installed position.

FIG. 3 shows the position of the driven and compressed elements of connector 20 after connector 20 is installed onto corrugated coaxial cable 10.

Figure 4:
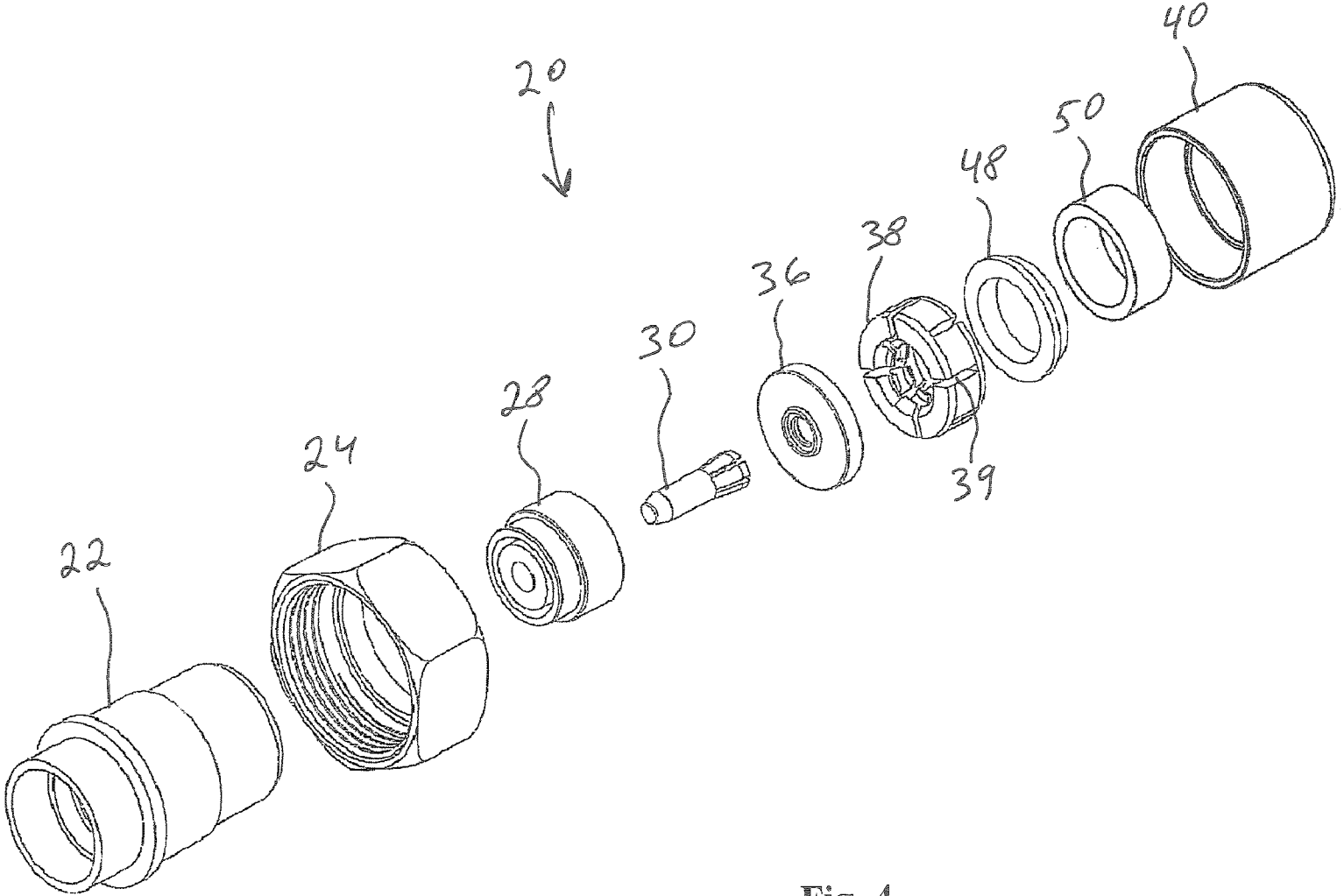
FIG. 4 shows an exploded view of the coaxial cable connector of FIG. 2.

Referring to FIG. 4, an exploded view is shown of the components of connector 20. During preferred assembly of the components of connector 20, conductive pin 30 is inserted into insulator 28, after which the combination is inserted into body 22, followed by mandrel 36, clamp 38, and drive ring 48. Seal 50 is positioned inside compression sleeve 40, after which the combination is slid onto/into body 22 after nut 24 is slid over the outside of body 22.

Figure 5:
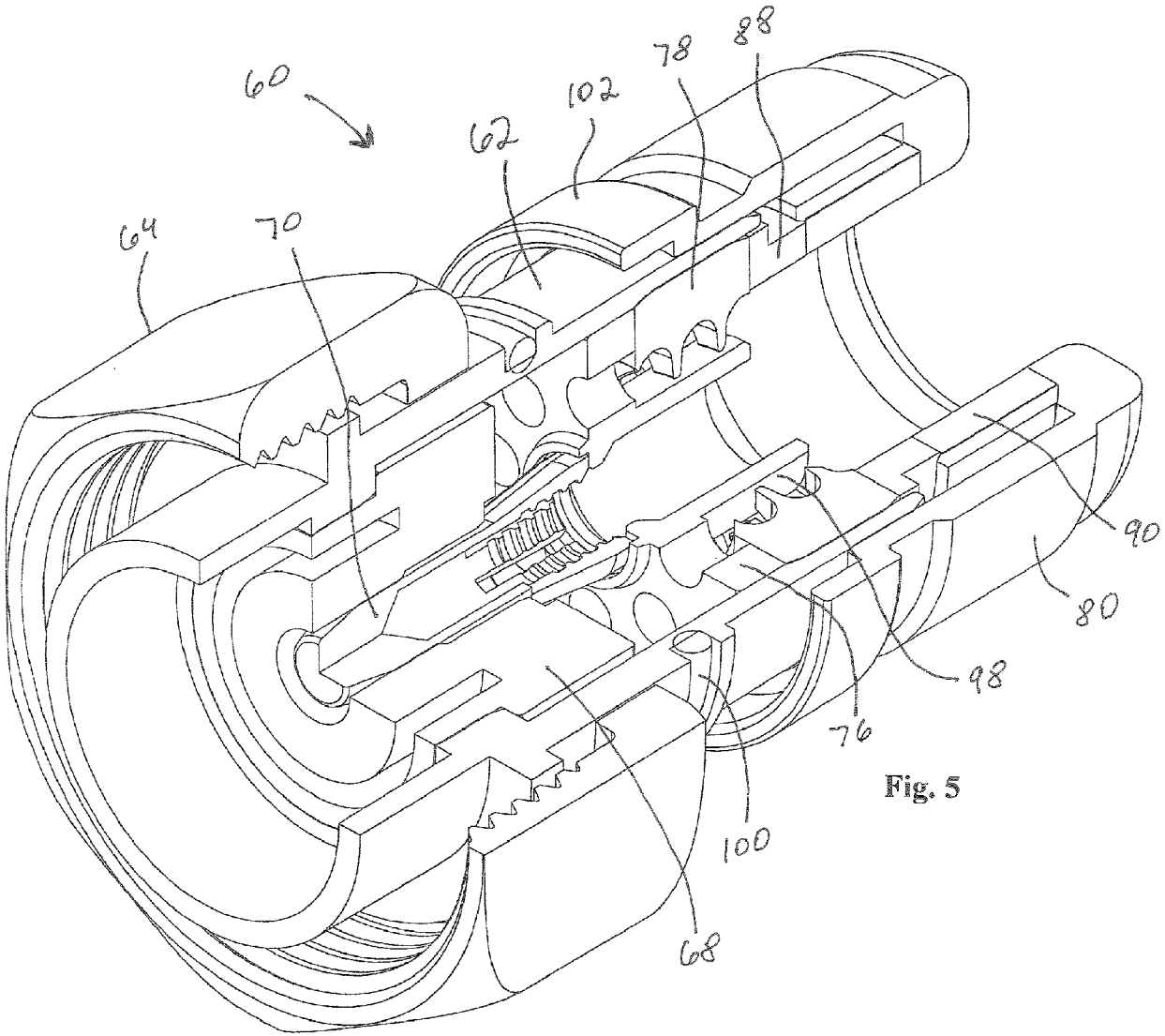
FIG. 5 shows a perspective view with a partial cut-away of a coaxial cable connector in accordance with a second embodiment of the present invention for use with an annular corrugated coaxial cable.

Referring now to FIGS. 5-6, and referring back to FIG. 1B, a compression connector 60 is similar to compression connector 20 of FIGS. 2-4, but with a mandrel 76 having an extended portion 98 which fits into hollow 58 of corrugated coaxial cable 10' during installation of connector 60 onto cable 10'. Extended portion 98 provides support to the spiral corrugated conductor layer 14 during compression. Another difference between embodiments is that a body 62 of connector 60 is shaped somewhat differently to accommodate an O-ring 100 which provides sealing with a portion 102 of a compression sleeve 80 when connector 60 is installed onto cable 10'. The remainder of the components of connector 60 interoperate the same way as the components of the embodiment of connector 20 and are not described further herein.

Figure 7:
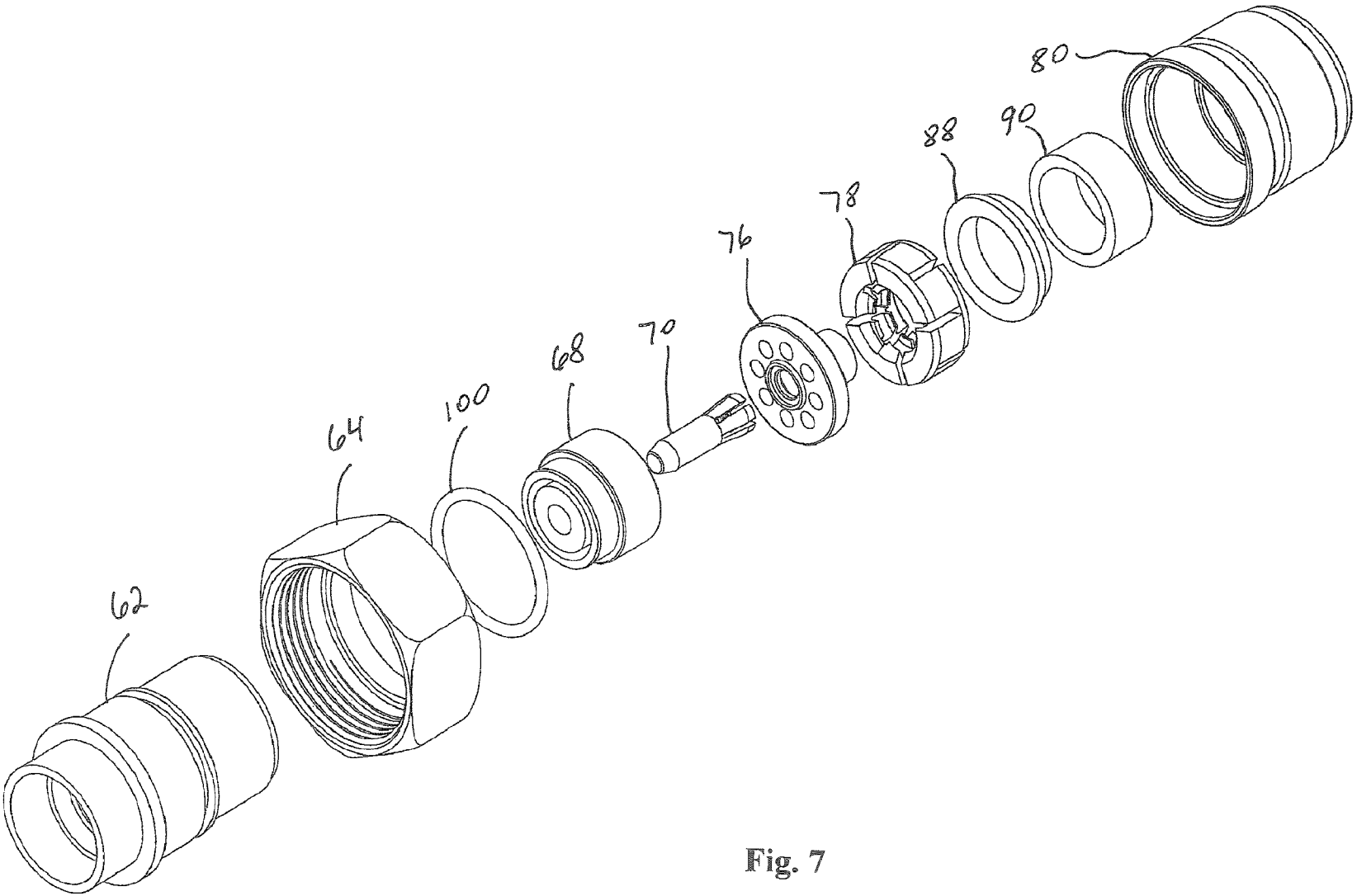
FIG. 7 shows an exploded view of the coaxial cable connector of FIG. 6.

Referring to FIG. 7, an exploded view is shown of the components of connector 60. During preferred assembly, an O-ring 100 is placed onto body 62. A conductive pin 70 is inserted into insulator 68, after which the combination is inserted into body 62, followed by mandrel 76, a clamp 78, and a drive ring 88. A seal 90 is positioned inside compression sleeve 80, after which the combination is slid onto/into body 62 after nut 64 is slid over the outside of body 62. During compression, an inner diameter of seal 90 decreases, thus forming a seal around jacket 12. This provides strain relief on the cable and also aids in cable retention.

Figure 8:
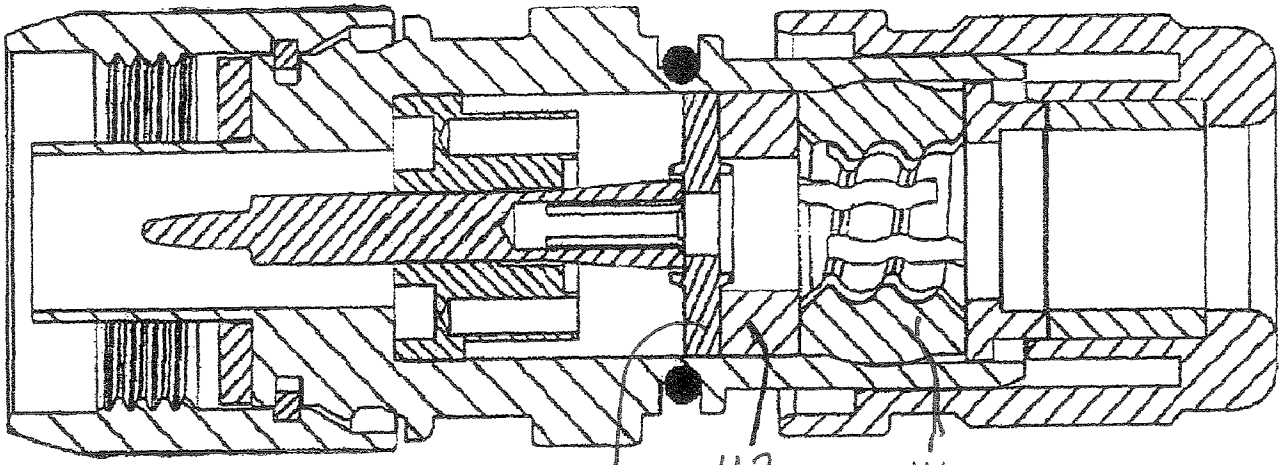
FIG. 8 shows a cross-section of a coaxial cable connector taken along the line 8-8 in FIG. 9 in accordance with a third embodiment of the present invention shown in the uninstalled position.
Figure 9:
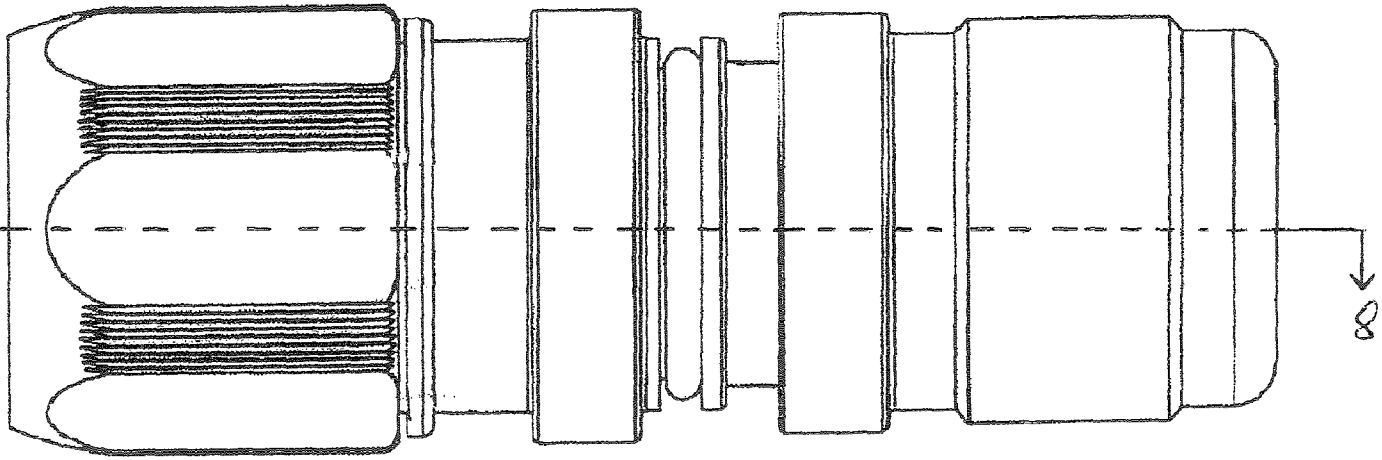
FIG. 9 shows a side elevation view of the coaxial cable connector of FIG. 8.
Figure 10:
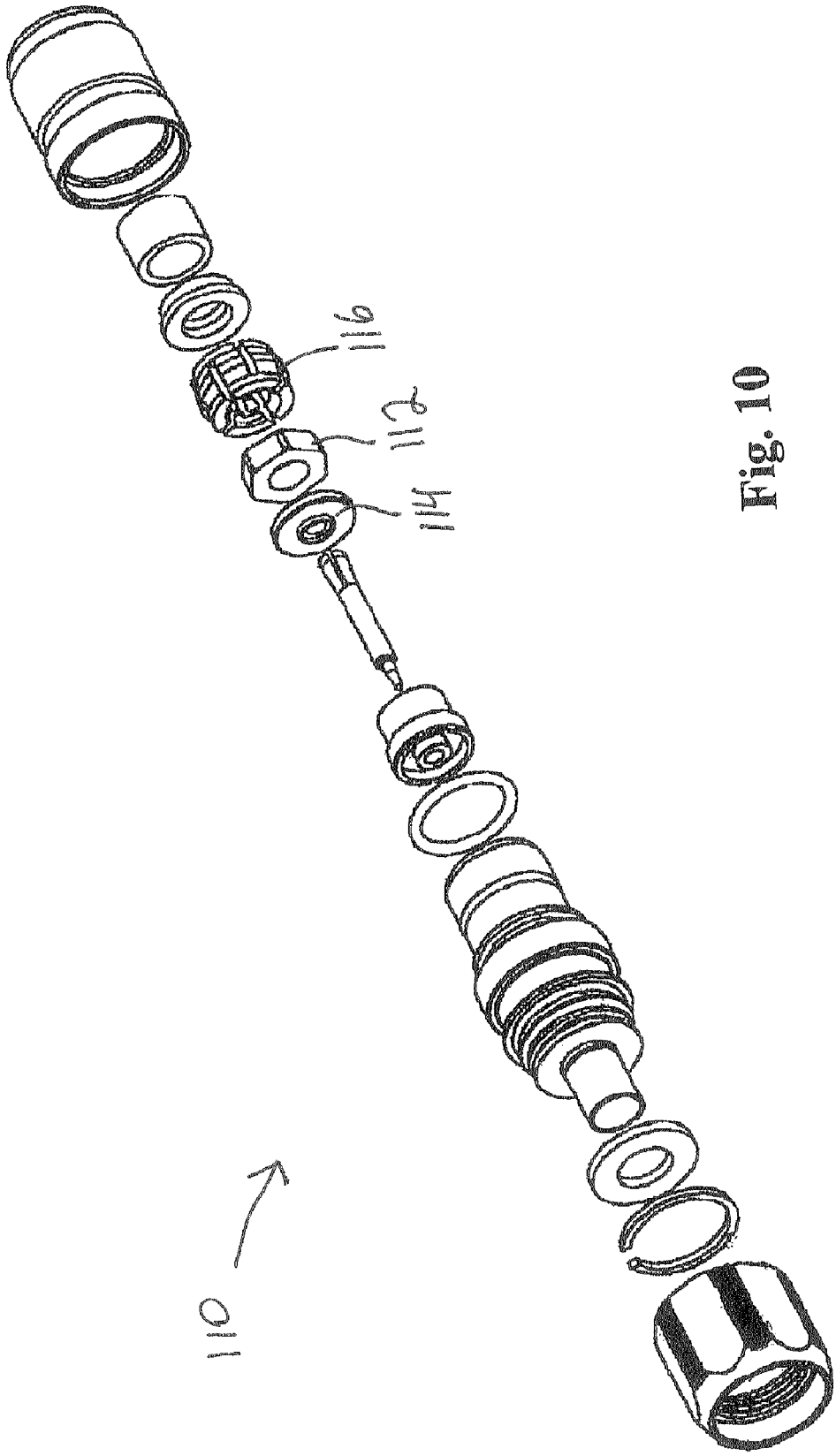
FIG. 10 shows an exploded view of the coaxial cable connector of FIG. 2.

Referring to FIGS. 8-10, a compression connector 110 is shown which is similar to the previous embodiments, but which includes a spacer 112 between a mandrel 114 and a clamp 116. The addition of spacer 112 may assist in better impedance matching. During installation of connector 110 onto corrugated coaxial cable 10 (FIG. 1A), clamp 116 forces spacer 112 against mandrel 114 instead of acting directly against mandrel 114. It should be obvious to one of ordinary skill in the art that such variations are within the scope of the invention. The remainder of the components of this embodiment interact in the same manner as the previous embodiments, so that further description is omitted.

Figure 11A:
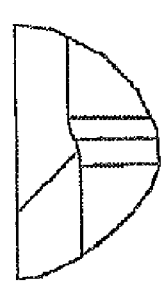
FIG. 11A shows an expanded view of a transitional surface circled in FIG. 11 in accordance with an embodiment the present invention.
Figure 11B:
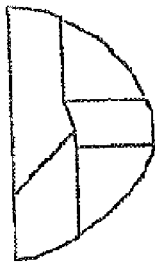
FIG. 11B shows an expanded view of a convex transitional surface circled in FIG. 11 in accordance with an embodiment the present invention.
Figure 11C:
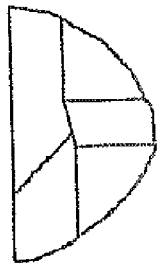
FIG. 11C shows an expanded view of a ramped transitional surface circled in FIG. 11 in accordance with an embodiment the present invention.
Figure 11D:
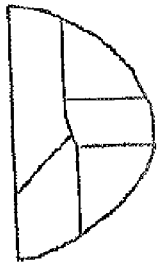
FIG. 11D shows an expanded view of a concave transitional surface circled in FIG. 11 in accordance with an embodiment the present invention.
Figure 11:
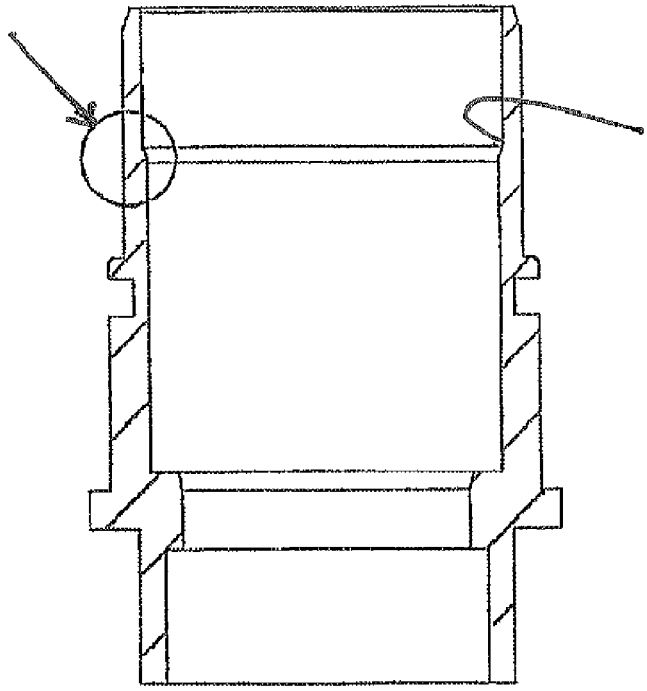
FIG. 11 shows a cross-section of a connector body in accordance with an embodiment of the present invention.

Referring to FIG. 11, transition surface 52 may take various forms, including a shoulder, a ramped or tapered surface, or various shapes such as convex, concave or radial. FIG. 11A shows a shoulder, FIG. 11B shows a convex surface, FIG. 11C shows a ramped surface, and FIG. 11D shows a concave surface.

Figure 12:
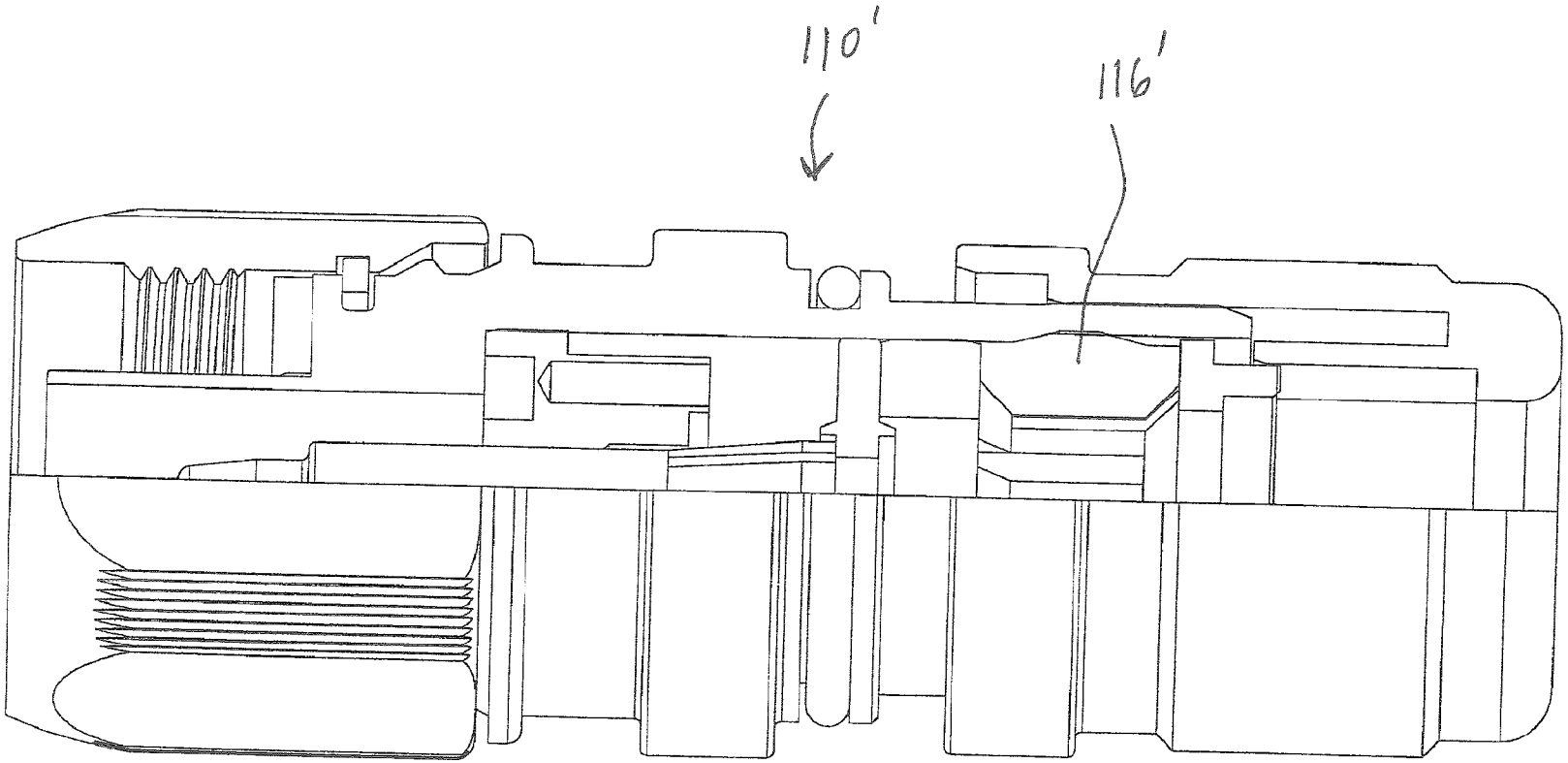
FIG. 12 shows a cross-section of a coaxial cable connector according to an embodiment of the present invention which is similar to the cable connector of FIG. 8 but intended for installation on a smooth-walled coaxial cable.

Referring to FIG. 12, a coaxial cable connector 110' is shown which is similar to cable connector 110 (FIG. 8) but which is intended for installation on smooth-walled coaxial cable 10''' (FIG. 1D). Note that clamp 116', unlike clamp 116 of FIG. 8, does not contain valleys and ridges corresponding to the valleys and ridges of corrugated coaxial cable in order to provide greater gripping surface.

Figure 13:
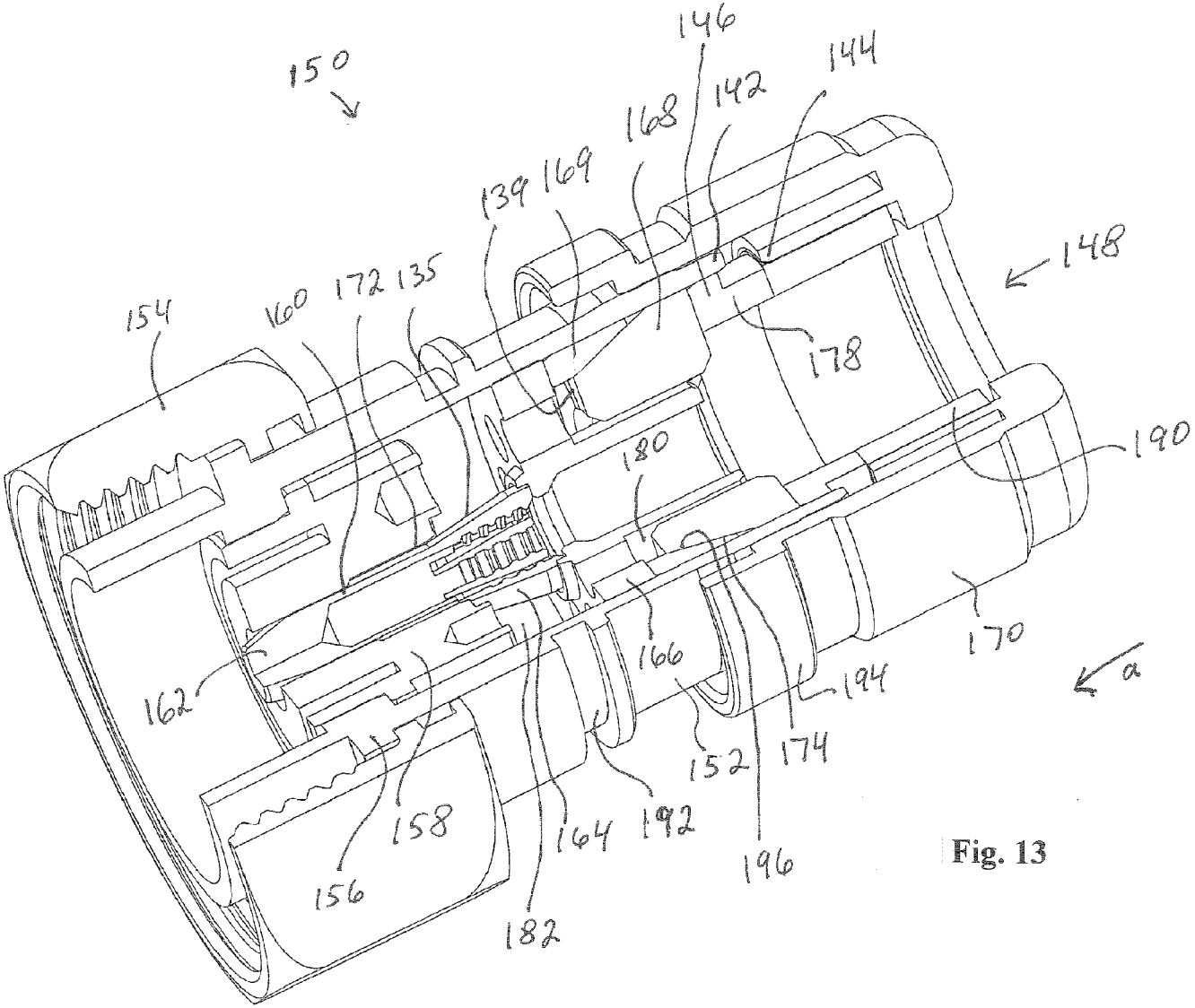
FIG. 13 shows a partial cross sectional view of a coaxial cable connector in accordance with an embodiment of the present invention.
Figure 14:
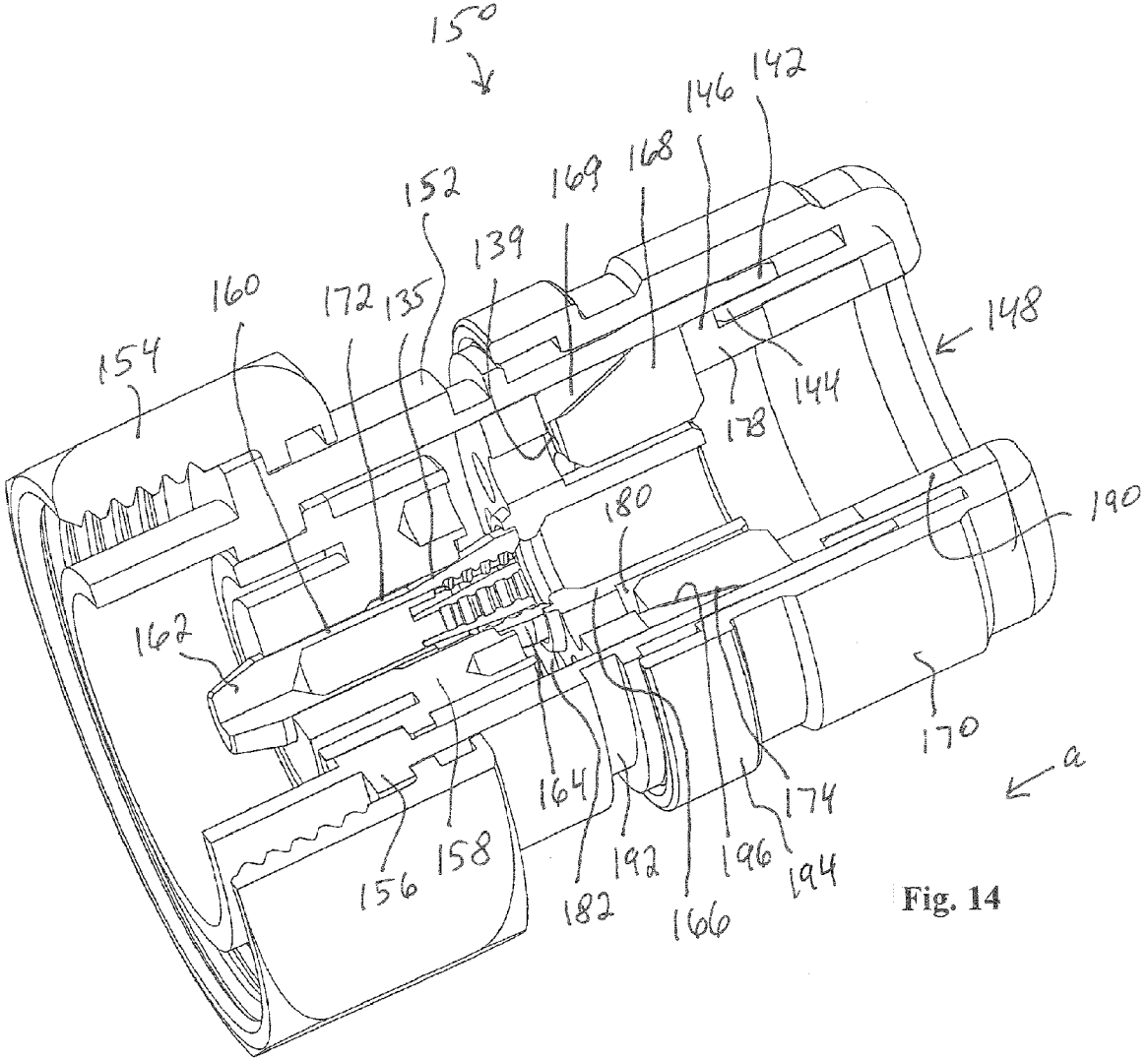
FIG. 14 shows a partial cross sectional view of a coaxial cable connector at a certain stage of compression in accordance with the embodiment of FIG. 13.
Figure 15:
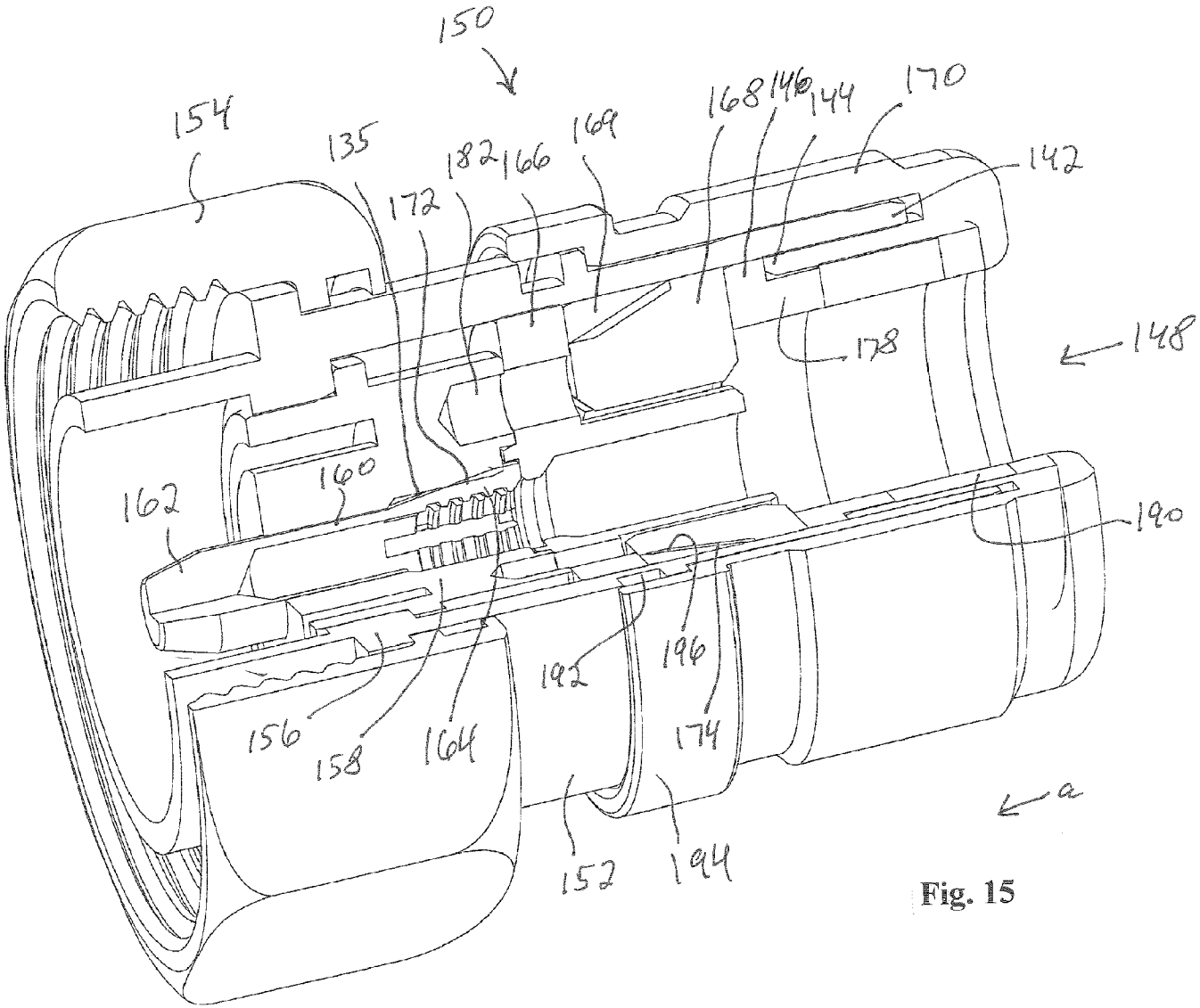
FIG. 15 shows a partial cross sectional view of a coaxial cable connector at a compressed stage in accordance with the embodiment of FIG. 13.

Referring to FIG. 13, a compression connector 150 is shown in a partially compressed position, while FIG. 14 shows the same compression connector 150 in a more fully compressed position, and FIG. 15 shows the same compression connector 150 in a fully compressed position. That is, FIG. 15 shows the position of the driven and compressed elements of connector 150 after connector 150 is installed onto coaxial cable 10, 10', 10'', 10''', 10''''.

Referring to FIGS. 13-15, compression connector 150 includes a body 152 with a nut 154 connected to body 152 via an annular flange 156. An insulator 158 positions and holds a conductive pin 160 within body 152. Conductive pin 160 includes a pin portion 162 at one end and a collet portion 164 at the other end. A drive insulator or mandrel 166 is positioned inside body 152 between and end of collet portion 164 and a clamp 168. Clamp 168 optionally has an interior annular surface which is geometrically congruent to the spiral of spiral corrugated conductor layer 14 when connector 150 is to be used with spiral corrugated coaxial cable; otherwise the interior annular surface of clamp 168 is generally smooth. Clamp 168 preferably includes a plurality of slots 139 in an outer annular portion of the clamp, so that clamp 168 can be compressed or squeezed inward. A part of a compression sleeve 170 fits over an end 142 of body 152. A drive portion 144 of compression sleeve 170 fits against an annular flange 146 of a drive ring 178. An elastomer seal 190 fits against jacket 12 of coaxial cable 10,10',10",10''',10'''' during installation to prevent external environmental influences (moisture, grit, etc.) from entering connector 150 as well as to provide strain relief and increase cable retention.

Mandrel 166 preferably includes an extended portion 180 which provides support to conductor layer 14, 14', 14", 14''' during compression and may assist in better impedance matching than without portion 180. An annular groove 192 accommodates an O-ring (item 100 in FIG. 5) which provides sealing with a portion 194 of compression sleeve 170 when connector 150 is installed onto cable 10, 10', 10", 10''', 10''''.

Connector 150 preferably includes a transition member 169 which fits inside body 152, with an outer surface of transition member 169 making good electrical contact with an inner surface of body 152. The outer surface of transition member 169 is preferably smooth but may be ridged or roughened or otherwise not smooth. A transition surface 196 on an inner surface of transition member 169 cooperates with an outer engagement surface 174 of clamp 168 as connector 150 is fitted onto coaxial cable 10, 10', 10", 10''', 10'''' to drive clamp 168 radially inward.

When prepared coaxial cable 10, 10', 10", 10''', 10'''' is inserted into an opening 148 of connector 150, center conductor 18 fits into collet portion 164. When compressive force is applied to compression sleeve 170 in the direction indicated by an arrow a, drive portion 144 of compression sleeve 170 drives drive ring 178 against clamp 168, forcing clamp 168 against transition surface 196 of transition member 169, which transition surface 196 is configured to radially inwardly squeeze clamp 168 against conductor layer 14, 14', 14", 14''' while continuing to move clamp 168 axially in the direction of arrow a. Clamp 168 thus forces mandrel 166 to move in the direction of arrow a, and mandrel 166 forces collet portion 164 of conductive pin 160 through an opening 172 in insulator 158. Opening 172 may take various forms, including convex, concave, or radial. Collet portion 164 also has a collet transition surface 135 configured to compress collet portion 164 radially inwardly upon advancement of conductive pin 160 into opening 172 of insulator 158. Because a diameter of opening 172 is smaller than an outer diameter of ramped collet transition surface 135 of collet portion 164, collet portion 164 is squeezed onto and seizes center conductor 18 of coaxial cable 10, 10', 10", 10''', 10''''. It should be noted that, during the clamping process, center conductor 18, now located within conductive pin 160, does not move relative to pin 160 during the clamping process. With the transition surface as shown in FIGS. 13-15, collet portion 164 is simultaneously compressed radially inwardly at the same time clamp 168 is compressed radially inwardly. Transition surface 135 however, can be designed to have a portion of surface 135 consistent with the diameter of opening 172, such that the squeezing of collet portion 164 is delayed until a greater advancement of compression sleeve 170 than is otherwise the case.

During installation of any of these embodiments onto spiral corrugated coaxial cable 10 (FIG. 1A), non-spiral corrugated coaxial cable 10', and smooth walled coaxial cable 10''', connectors 20,60, 110, 150 have to be relatively immovable while compressive force is applied to the respective compression sleeves in the direction of arrow a (FIGS. 2 & 13). The preferred design of a compression connector tool to accomplish the installation would, while applying the compressive force in the direction of arrow a, stabilize the connector in the opposing direction, thus ensuring that the compressive force was sufficient to squeeze the respective clamps around the conductor layer of the corrugated coaxial cable and squeeze the respective collet portions onto the center conductor. Although the squeezing of the respective clamps begins slightly before the squeezing of the respective collet portions, the squeezing of the respective clamps and collet portions mainly happens simultaneously, unlike with prior art embodiments which require a two-stage operation.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A compression connector for a coaxial cable, the connector comprising:

a connector body;

a compression sleeve, the compression sleeve being configured to engage the connector body with the coaxial cable positioned therein;

first clamp means, disposed in the connector body, first clamp means comprising:

a shoulder disposed on an inside of the connector body, the shoulder separating the connector body into a first portion having a first inner diameter and a second portion having a second inner diameter; and, a clamp having an outer diameter, the outer diameter of the clamp being substantially the same as the first inner diameter but greater than the second inner diameter; and second clamp means, disposed within the connector body, for clamping onto a center conductor of the coaxial cable, wherein under the condition that one of the connector body and the compression sleeve is axially advanced toward the other from a first state to a second state, the first and second clamp means are radially displaced inwardly.

2. The compression connector of claim 1, further comprising:

an insulator disposed within the connector body, the insulator having an opening therein;

wherein the second clamp means comprises:

a conductive pin having a collet portion at one end thereat wherein an outer diameter of the collet portion is greater than a diameter of the opening in the insulator, such that axially advancing one of the connector body and the compression sleeve toward the other from the first state to the second state axially advances the collet portion into the opening resulting in the outer diameter of the collet portion reducing in size.

3. The compression connector of claim 1, the first clamp means further comprising:

the connector body having a transition surface separating the connector body into a first portion having a first inner diameter and a second portion having a second inner diameter; and a clamp having an outer diameter, the outer diameter of the clamp being substantially the same as the first inner diameter but greater than the second inner diameter, and wherein axially advancing one of the connector body and the compression sleeve toward the other from the first state to the second state axially advances the clamp from within the first portion of the connector body to within the second portion of the connector body resulting in the outer diameter of the clamp reducing in size.

4. The compression connector according to claim 1, further comprising a drive ring disposed between the compression sleeve assembly and the first clamp means.

5. The compression connector of claim 1, the first clamp means comprises:

a clamp having a first section and a second section, the first section having an outer engagement surface; and a transition member disposed within the connector body, the transition member having a transition surface and an exterior surface, the exterior surface configured to functionally engage an interior surface of the connector body, and wherein axially advancing one of the connector body and the compression sleeve toward the other from the first state to the second state results in the outer engagement surface of the clamp engaging the transition surface of the transition member such that the clamp reduces radially inwardly in size.

6. The compression connector according to claim 5, wherein the clamp further comprises slots, wherein the slots extend axially within the clamp a distance from a leading edge of the first section of the clamp to facilitate radial compression.

7. The compression connector according to claim 1, further comprising a mandrel disposed between the second clamp means and the collet portion.

8. The compression connector according to claim 7, wherein the mandrel includes an extended portion which extends inside the clamp.

9. The compression connector according to claim 7, further comprising a spacer disposed between the clamp and the mandrel.

* * * * *